US005655455A

United States Patent [19]

Smith

[11] Patent Number: 5,655,455

[45] Date of Patent: Aug. 12, 1997

[54] TIE PLATE PLACER

[75] Inventor: Elbert Rudolph Smith, Montgomery, Ala.

[73] Assignee: Kershaw Manufacturing Co., Inc., Montgomery, Ala.

[21] Appl. No.: 655,970

[22] Filed: May 31, 1996

[51] Int. Cl.[6] ..... E01B 29/32

[52] U.S. Cl. ..... 104/16

[58] Field of Search ..... 104/2, 9, 16

[56] References Cited

U.S. PATENT DOCUMENTS

| | | | |
|---|---|---|---|
| 3,943,858 | 3/1976 | Dieringer et al. | 104/16 |
| 4,241,663 | 12/1980 | Lund et al. | 104/16 |
| 4,691,639 | 9/1987 | Holley | 104/16 |
| 5,067,412 | 11/1991 | Theurer et al. | 104/16 |
| 5,331,899 | 7/1994 | Holley | 104/16 |

*Primary Examiner*—S. Joseph Morano
*Attorney, Agent, or Firm*—Veal & Associates

[57] ABSTRACT

An apparatus for placing tie plates between a rail and selected crossties along a railroad track. The apparatus includes a mobile frame which travels on the rails along a railroad track and carries a magnetic wheel for retrieving loose tie plates, a magazine for holding and positioning the loose tie plates over a selected rail lie, a rail jack for lifting the rail away from the tie to allow insertion of the tie plate, and an insertion arm and plate which urge the tie plate into position between the tie and the rail. The magazine holds a number of tie plates and has an elongated guide plate, dimensioned to fit the rail receiving area of the tie plates. A series of biased linkages, arranged vertically along the guide plate, urge the tie plates against the guide plate to hold them in place. The lowermost tie plate is supported by a plate stop at the lower end of the guide plate, and a biased retaining lever, which urges the tie plate against the guide plate, until an operator actuates an ejection arm to push the tie plate off of the stop and onto the cross tie below. After the rail is lifted, an insertion arm, having an insertion plate connected to its lower end, is actuated to urge the tie plate between the rail and the tie.

27 Claims, 8 Drawing Sheets

TIE PLATE PLACER

FIELD OF THE INVENTION

The present invention relates to railroad repair equipment and more particularly, to railroad repair equipment used in handling tie plates. In greater particularity, the present invention relates to railroad equipment for retrieving tie plates from a railbed and placing the retrieved tie plates between a rail and selected rail ties supporting the rail.

BACKGROUND OF THE INVENTION

In routine maintenance of a railroad track, railroad ties must be replaced. Doing so requires a number of steps, which include: (1) removing the spikes which secure the tie plate to the cross tie; (2) removing the tie from beneath the rail; (3) inserting a new tie; (4) retrieving the tie plates; (5) lifting the rail off of the new tie; (6) placing the tie plates between the new tie and the rail; and (7) securing the tie plate to the new tie.

Devices for removing and replacing the spikes, removing and replacing the ties, and lifting the rail are well known in the art.

Presently, however, the processes of retrieving the tie plates and placing the tie plates between the new tie and the rail are performed manually. A concept for an apparatus for retrieving tie plates from a railbed and automatically placing them between a newly inserted tie and a rail is disclosed in U.S. Pat. No. 5,331,899 issued to Holley. Holley's invention makes use of a fairly complex series of magnetic wheels and belts to accomplish its objective. Applicant believes his invention to be superior to the device patented by Holley because of the relative simplicity of Applicant's design. Further, applicant's invention provides the capability of automatically positioning the insertion equipment to accommodate skewed ties.

SUMMARY OF THE PRESENT INVENTION

With the foregoing in mind, the principal object of the present invention is to provide an apparatus which automates the process of placing tie plates between rails and rail ties.

In support of the principal object, another object of the invention is to provide an apparatus which retrieves loose tie plates lying on the railbed such that the retrieved tie plates may be placed between the rail and a selected rail tie.

Another object of the present invention is to reduce the labor costs associated with placing rail ties by reducing the number of operators required to perform the job.

A further object of the invention is to provide an automatic plate placing apparatus which is capable of accurate placement of tie plates on skewed ties.

Yet another object of the present invention is to provide an automatic tie plate placer which, because of its design simplicity, is reliable and easily maintained.

These and other objects of the present invention are accomplished through the use of a mobile frame which travels on the rails along a railroad track and carries a magnetic wheel for retrieving loose tie plates, a magazine for holding and positioning the loose tie plates over a selected rail tie, a rail jack for lifting the rail away from the tie to allow insertion of the tie plate, and an insertion arm and plate which urge the tie plate into position between the tie and the rail.

A magnetic wheel is rotatably supported on the frame between the rails to magnetically engage loose tie plates which have been placed on the railbed. The tie plates are carried upwardly by the wheel until they are disengaged by contact with the edge of a collection slide positioned adjacent to the magnetic wheel. The tie plates slide toward the lower end of the slide, where they are retrieved by an operator. The operator, preferably using a magnetic handle, places the tie plate into a magazine which holds a plurality of tie plates. The magazine has an elongated guide plate, dimensioned to fit the rail receiving area of the tie plates. A tie plate is placed adjacent the upper end of the guide plate. A series of biased linkages, arranged vertically along the guide plate, urge the tie plate against the guide plate to hold the tie plate in place. As additional tie plates are loaded into the magazine, the lowermost tie plate overcomes the bias of the linkages and moves to the lower end of the guide plate, where it is supported by a plate stop, which extends outwardly from the tie plate receiving side of the lower end of the guide plate, and a biased retaining lever, which urges the tie plate against the guide plate.

The magazine is attached to a mounting head which is rotatably mounted on the mobile frame. An indexing clamp is operatively connected to either the mounting head or the magazine frame such that the mounting head rotates in response to the position of the indexing clamp. When the operator actuates the indexing clamp, and it grasps a selected rail tie, the mounting head rotates as necessary to align the magazine in proper position over the rail tie.

After the magazine has been positioned above the selected rail tie, the operator actuates a rail jack to lift the rail away from the tie. An ejection arm is then actuated to push the tie plate off of the plate stop so that it falls into position on the tie below. An insertion arm, having an insertion plate connected to its lower end, is then actuated to urge the tie plate between the rail and the tie.

BRIEF DESCRIPTION OF THE DRAWINGS

The foregoing objects and advantages of the present invention for a tie plate placer will be more readily understood by one skilled in the art by referring to the following detailed description of the invention and to the accompanying drawings which form a part of this disclosure, and wherein.

DETAILED DESCRIPTION OF THE INVENTION

Figure 1:
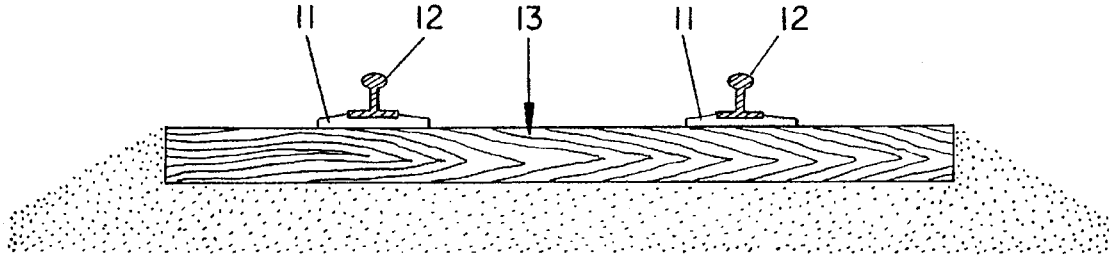
FIG. 1 is a sectional view showing the position of the tie plates relative to a crosstie and rails.
Figure 4:
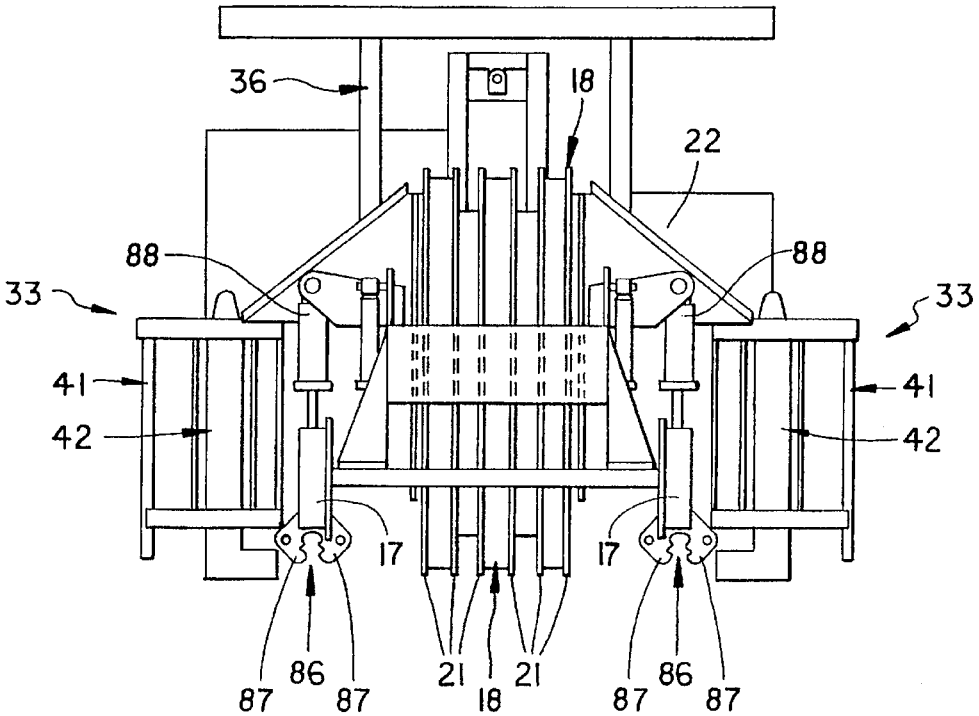
FIG. 4 is a from elevational view of the tie plate placer.
Figure 2:
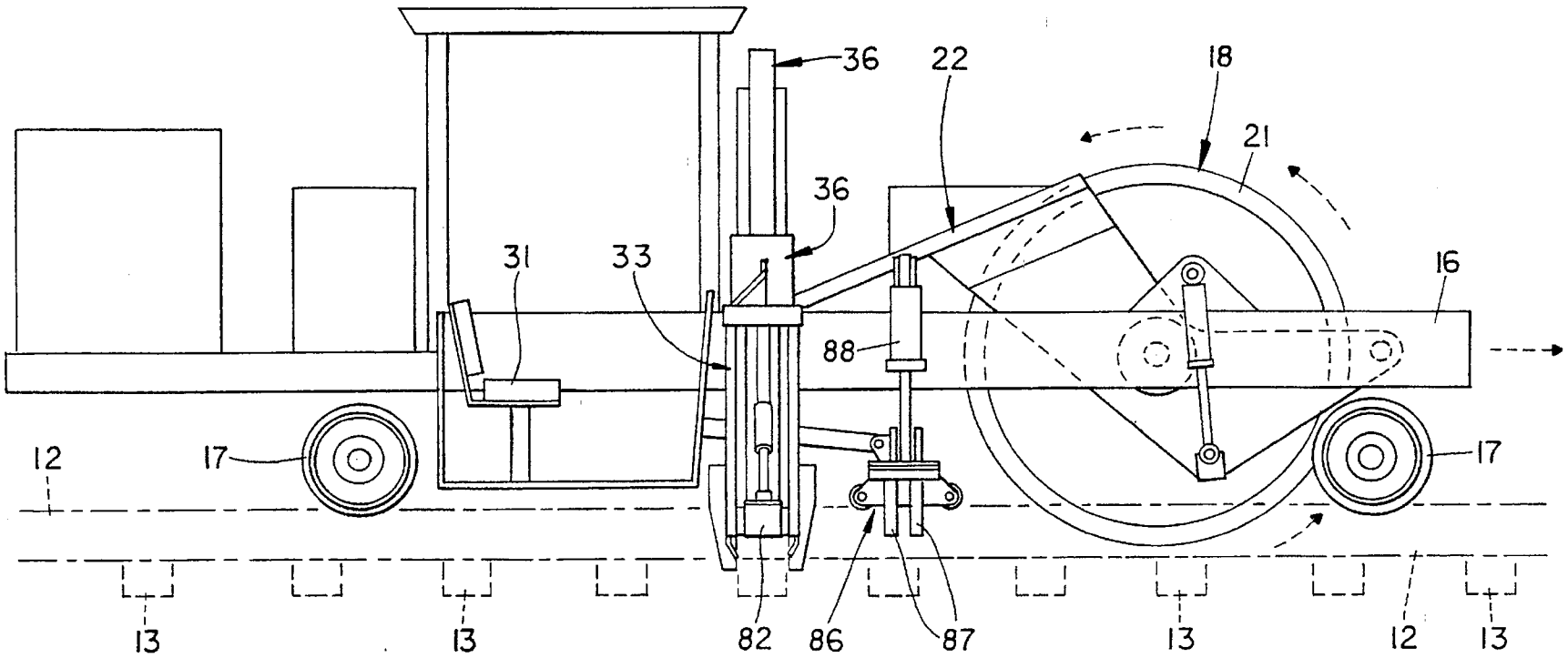
FIG. 2 is a side elevational view of the tie plate placer.
Figure 3:
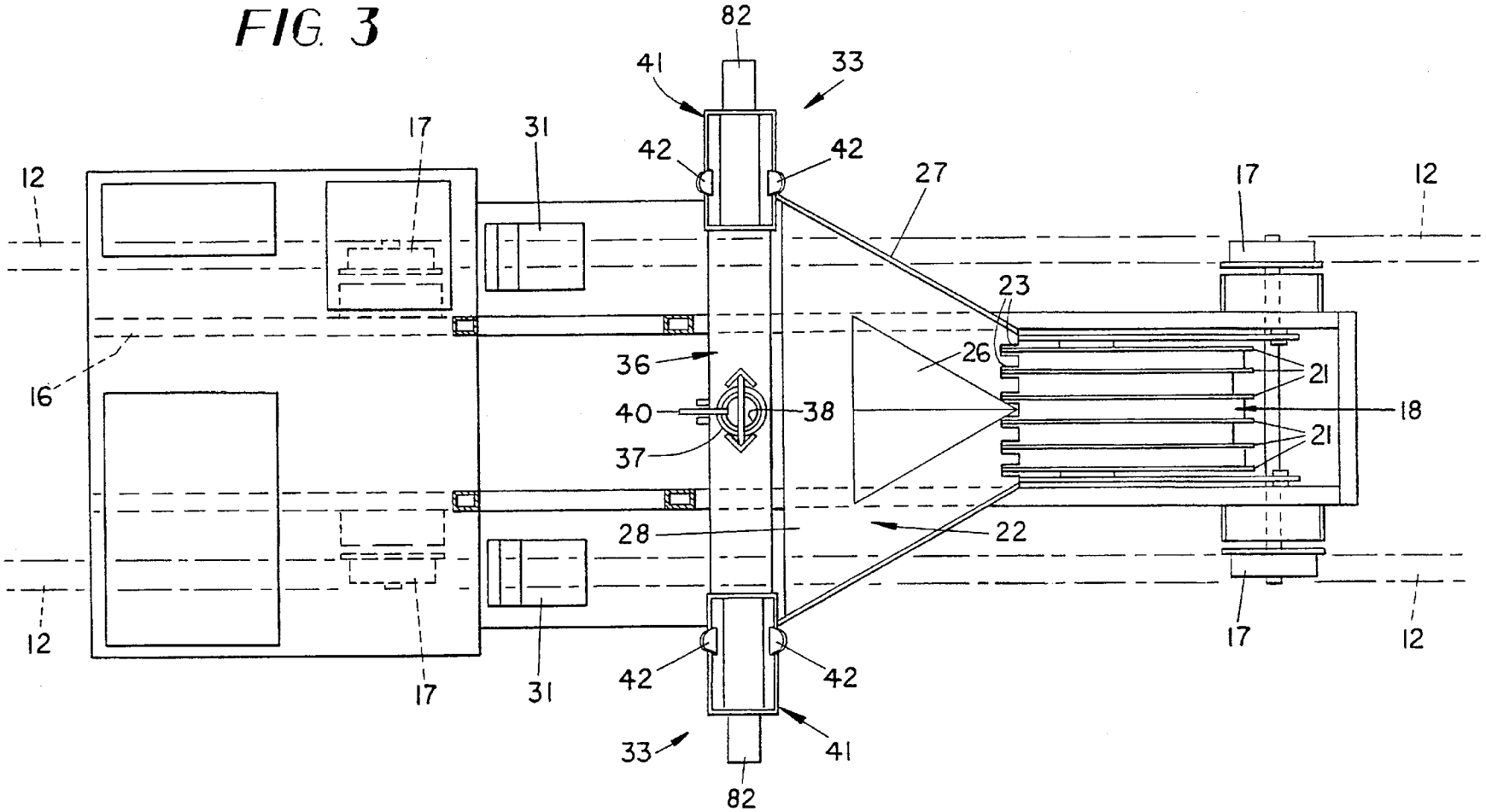
FIG. 3 is a top plan view of the tie plate placer.

Referring first to FIG. 1, tie plates 11 are shown in position between rails 12 and a crosstie 13. As shown in FIGS. 2–4, the apparatus of the present invention includes a mobile frame 16 which moves along rails 12 on rail-engaging wheels 17. A magnetic wheel 18 is mounted to the mobile frame 16 such that it travels along the railbed between the rails 12. The magnetic wheel 18 is driven by a motor (not shown) which causes it to rotate in a counter-clockwise direction when viewed as in FIG. 2. The magnetic wheel, 18 has a plurality of flanges 21 that extend around the rim of the magnetic wheel 18. A collection slide 22 is mounted on the mobile frame 16 next to the magnetic wheel 18. The edge of the slide 22 that is adjacent to the magnetic wheel 18 has a plurality of slots 23 defined therethrough for receiving the flanges 21 of the magnetic wheel 18. As the magnetic wheel 18 rotates counterclockwise, it carries a tie plate 11 around to the point where the flanges 21 protrude into the slots 23 of the collection slide 22. As the magnetic wheel 18 continues to rotate, the tie plate 11 is disengaged from the magnetic wheel 18 by the edge of the collection slide 22. A triangular shaped protrusion 26 extends upwardly from the upper surface of the collection slide 22. The protrusion 26 serves to direct the disengaged tie plates 11 toward the sides 27 of the collection slide 22, as the tie plates 11 slide to the base 28 of the collection slide 22.

In the preferred embodiment, dual operators' stations 31 are located next to the base 28 of the collection slide 22, one on each side of the mobile frame 16. The operator retrieves the tie plates 11 from the base 28 of the collection slide 22, using a magnetic handle 32, which is attached to the mobile frame 16 by a cable (FIG. 6), and places them in a tie plate magazine 33. With one operator located on each side of the apparatus, tie plates 11 may be inserted on both ends of a tie 13 simultaneously. Since the components on one side of the apparatus are the same and operate in the same fashion as those on the other, the description that follows pertains to both sides.

Figure 5:
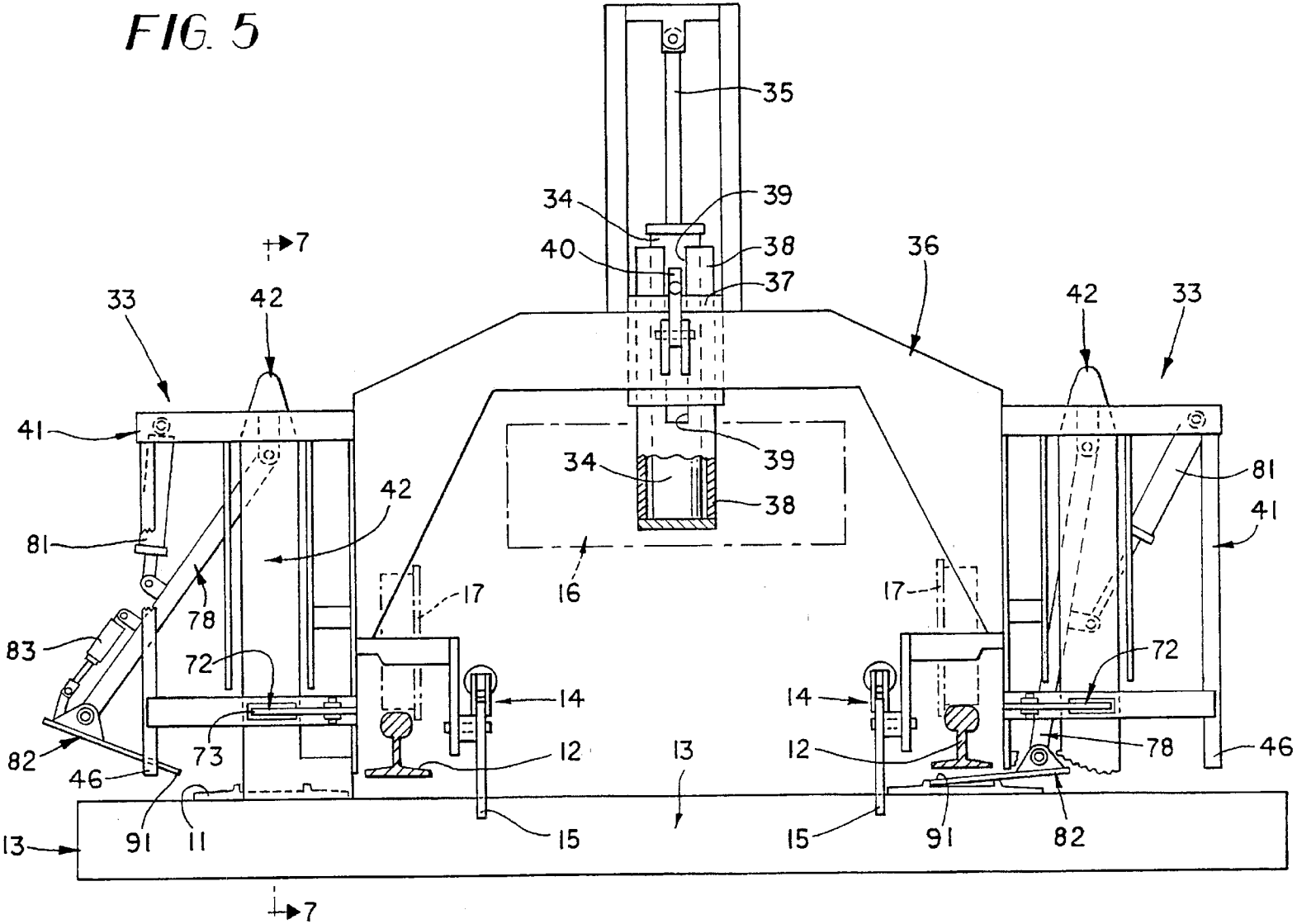
FIG. 5 is a front elevational view of the rotatable mounting head, showing the placement of the indexing clamp, the magazine and the insertion arm and insertion plate.
Figure 6:
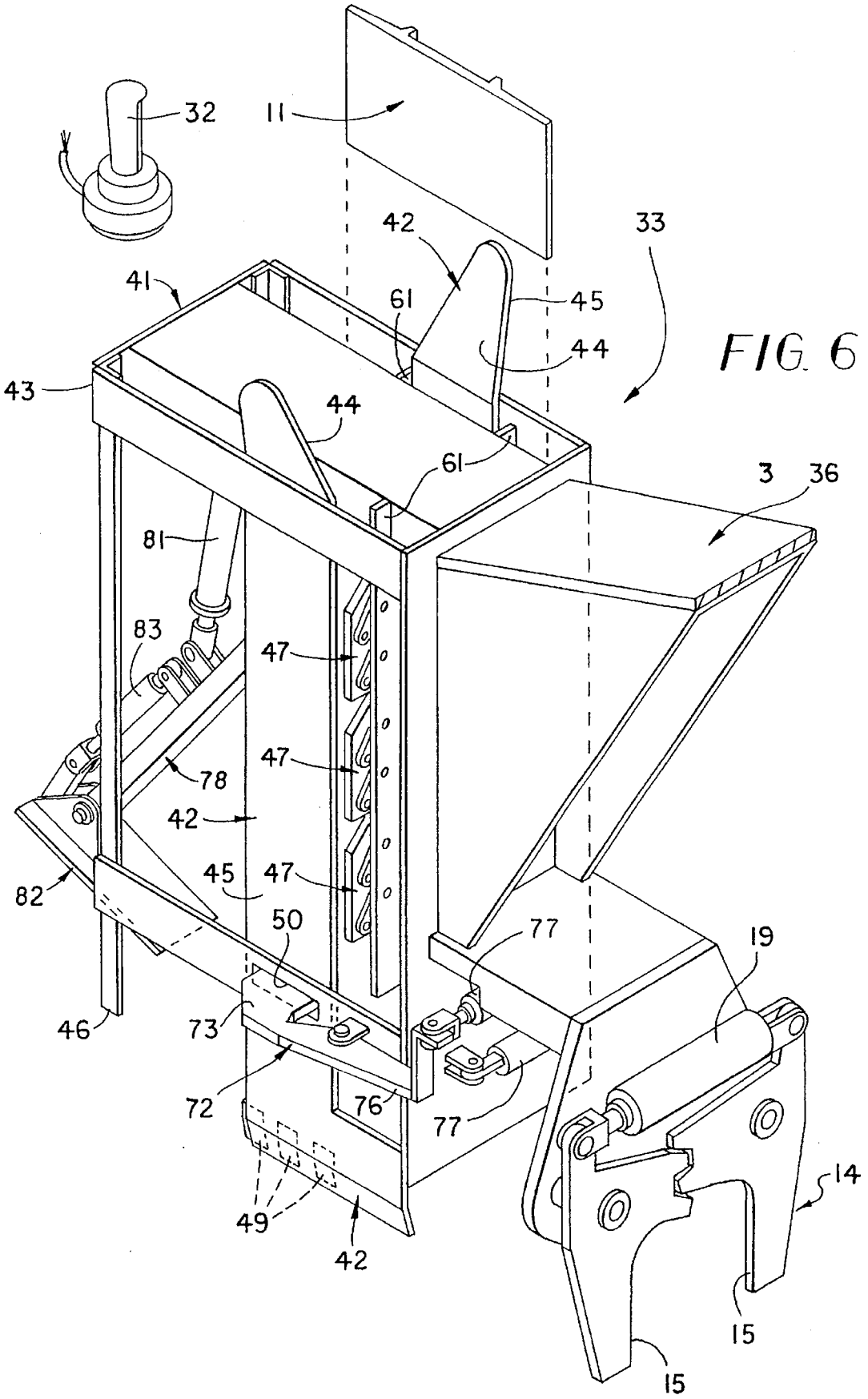
FIG. 6 is a perspective view of the magazine showing the indexing clamp.

The mobile frame 16 includes a mounting head 36, which is pivotally mounted between the base 28 of the collection slide 22 and the operators' stations 31 as best shown in FIGS. 2 and 3. The mounting head 36 is mounted by means of a mounting sleeve 37 which receives a stationary cylindrical pipe 38 affixed to the mobile frame 16 (FIG. 5). A hydraulic cylinder 34 is positioned within the pipe 38; The shaft 35 of the cylinder 34 extends upwardly and is attached to the mounting head 36. The mounting head 36 is accordingly movable vertically along the pipe 38 to accommodate crossties of varying heights. The mounting sleeve 37 and the remainder of the mounting head 36 rotate about the stationary pipe 38 within a limited range of motion. The pipe 38 has a slot 39 along its upper edge for receiving a locking arm 40 pivotally mounted to the mounting head 36. The locking arm 40, when it is pivoted into the slot 39, serves to lock the mounting head 36 in the center position. As shown in FIG. 5, tie plate magazines 33 are rigidly affixed to or integral with the mounting head 36. Indexing clamps 14 are rigidly affixed to either the mounting head 36 or the magazines 33. Each indexing clamp 14 includes a pair of indexing arms 15 pivotally connected to a hydraulic cylinder 19 as shown in FIG. 6. The indexing arms 15 are positioned to grasp the sides of a selected crosstie 13. When the locking arm 40 is disengaged from the slot 39, the mounting head 36 is pivotable about the pipe 38, in response to the position of the indexing clamps 14, to position the magazines 33 directly over the crosstie 13.

While it is not necessary to practice the invention, each magazine 33 has the same components on both the from and back of the magazine 33, so that tie plates 11 may be loaded on the front or the back of the magazine 33, or on both. It is obvious that the magazine 33 of the present invention could be constructed so that tie plates 11 could be loaded on only one side of the magazine 33. In the preferred embodiment, however, the magazine 33 receives tie plates 11 on both the front and back of the magazine 33. In addition to increasing the number of tie plates 11 that the magazine 33 is capable of holding, the dual-sided magazine gives an operator the flexibility of loading tie plates 11 of one length on one side of the magazine 33 and tie plates 11 of a different length on the other.

Figure 7:
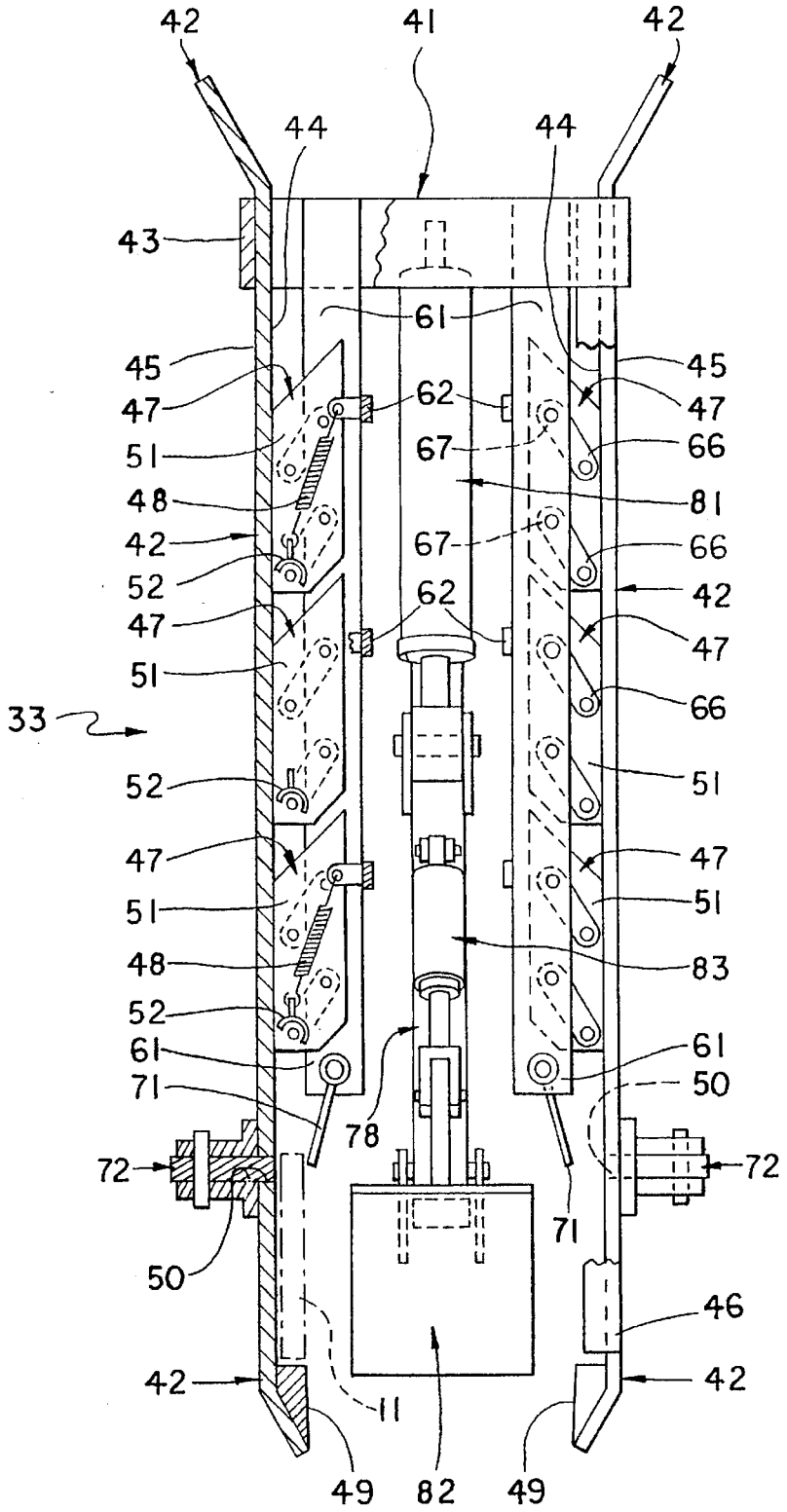
FIG. 7 is a sectional view of the magazine, taken along line 7—7 of FIG. 5.
Figure 8:
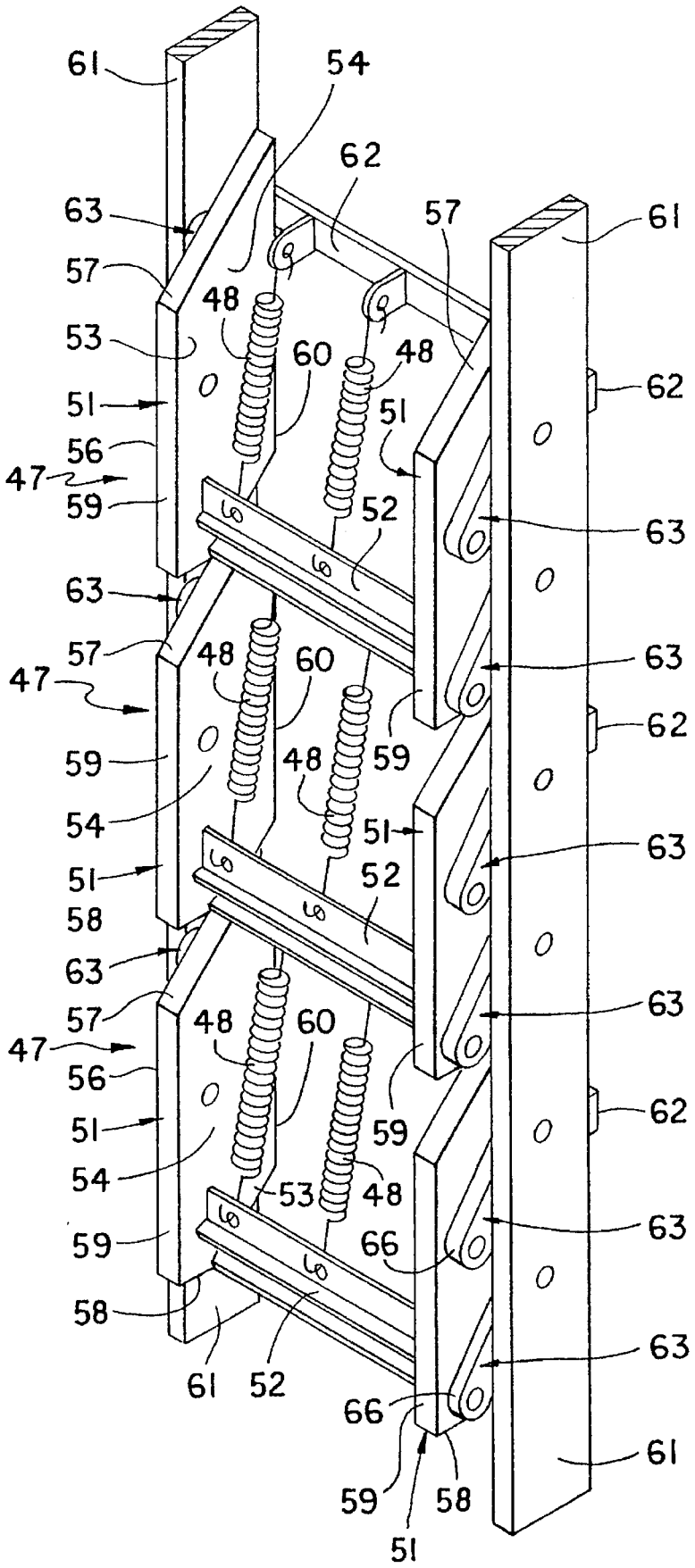
FIG. 8 is a perspective view of the biased linkages.
Figure 9:
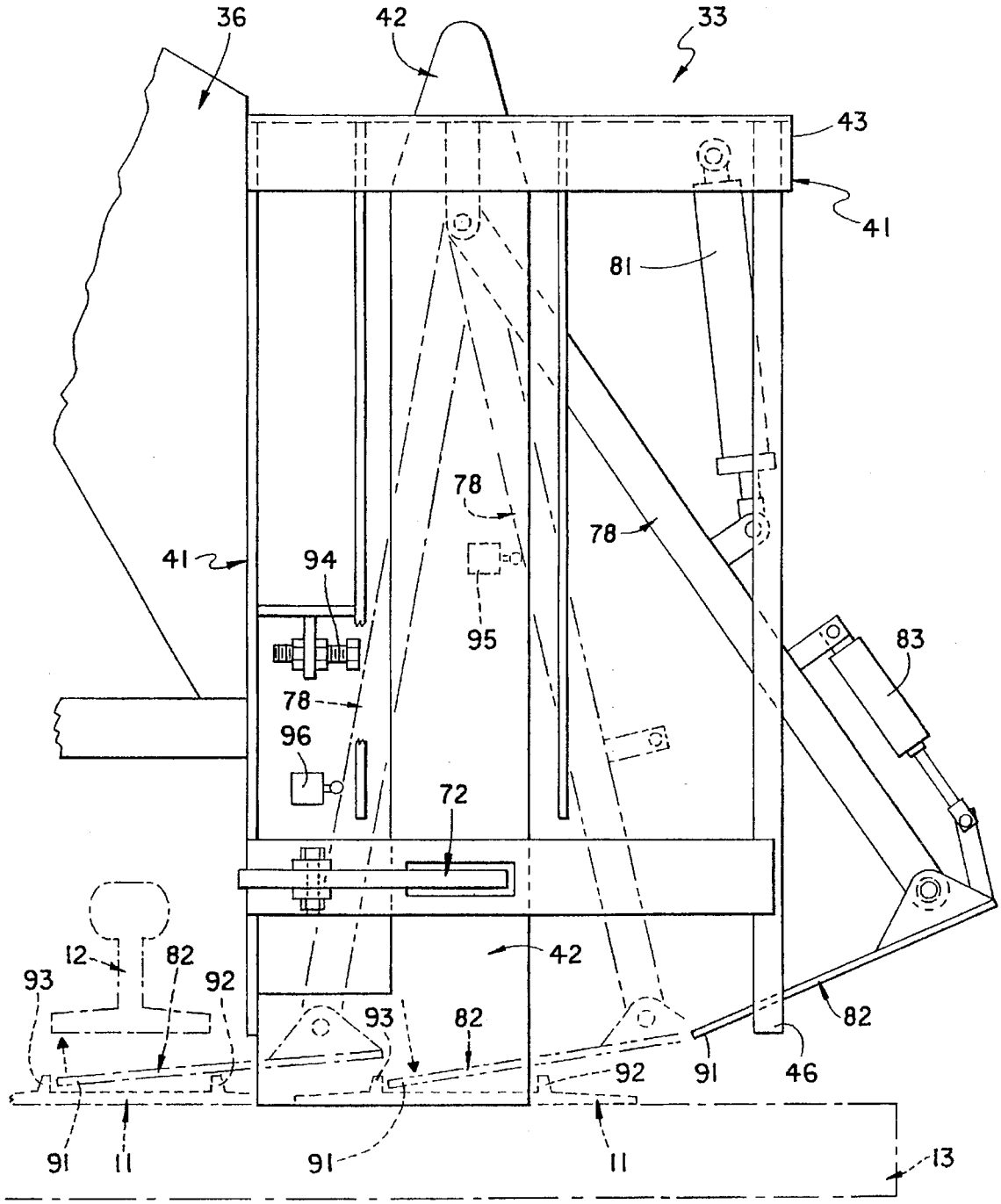
FIG. 9 is a from elevational view of the magazine showing the insertion arm and insertion plate.

Magazine 33 includes a magazine frame 41 which is affixed to or integral with the mounting head 36, as is best shown in FIG. 5, and from and rear guide plates 42, as shown in FIGS. 6 and 7. The guide plates 42 are elongated members which are attached to the magazine frame 41 and extend from the upper end 43 of the magazine 33 to its lower end 46 (see FIG. 5). Each guide plate 42 has a tie plate receiving side 44, an external Side 45, a plate stop 49 and a slot 50. A plurality of parallelogram linkages 47 are biased with springs 48 toward the tie plate receiving side 44 of each guide plate 42, as is best shown in FIGS. 7–8.

Each parallelogram linkage 47 includes a pair of parallelogram-shaped plates 51. Each plate has an inner surface 53, an outer surface 56, an upper end 57, a lower end 58, a middle portion 54, a tie plate edge 59 and a rear edge 60. A spring-connecting member 52 is affixed to and extends between the inner surfaces 53 of the two plates 51, proximal the lower end 58 of the plates 51. Elongated frame members 61 are affixed to the magazine frame 41 and extend vertically from the upper end 43 of the magazine 33 to the lower end 46 of the magazine, proximal the rear edges 60 of the parallelogram-shaped plates 51. Cross bars 62 are rigidly affixed to and extend between frame members 61, adjacent the rear edges 60 of the upper ends 57 of each of the parallelogram-shaped plates 51. For each plate 51, two linking members 63, each having a plate-connecting end 66 and a frame-connecting end 67 are pivotally mounted between the outer surface 56 of the parallelogram-shaped plate 51 and the elongated frame member 61 proximal the outer surface 56 of the plate 51. The plate-connecting end 66 of a first linking member 63 is pivotally mounted to each plate 51 proximal the middle portion 54 and the tie plate edge 59 of the plate 51. The plate-connecting end 66 of a second linking member 63 is pivotally mounted to each plate 51 proximal the lower end 58 and tie plate edge 59 of the plate 51. The frame-connecting ends 67 of the linking members 63 are pivotally connected to the elongated frame members 61. In each linkage 47, springs 48 are connected at one end to the spring-connecting member 52, and at the other end to the cross bar 62, as shown in FIG. 8. The springs, 48 bias the plates 51 toward the guide plate 42.

As best shown in FIG. 7, retaining levers 71 are pivotally mounted to the magazine frame 41 proximal the tie plate receiving side 44 of the lower end of each guide plate 42. Each retaining lever 71 is biased with a spring (not shown) toward the tie plate receiving side 44 of the adjacent guide plate 42, such that when a tie plate 11 is resting on the plate stop 49, the retaining lever 71 holds the tie plate against the guide plate 42.

As shown in FIGS. 5–7, ejection arms 72, each having an impact end 73 and an actuating end 76, are pivotally mounted to the magazine frame 41. Each ejection arm 72 is movable between a rest position adjacent the external side 45 of the guide plate 42, and an ejection position wherein the impact end 73 of the ejection arm 72 extends through the slot 50 in the guide plate 42. The actuating end 76 of each ejection arm 72 is connected to a hydraulic cylinder 77 mounted on the magazine frame 41.

Rail lifters 86 are affixed to the mobile frame 16 between the magnetic wheel 18 and each magazine 33, as shown in FIGS. 2 and 4. Each rail lifter 86 includes a rail clamp 87 to engage the rail and a hydraulic cylinder 88 that lifts the clamp 87 when actuated by the operator.

An insertion arm 78 is pivotally mounted to the magazine frame 41 as shown in FIG. 5. The insertion arm 78 is actuated by hydraulic cylinder 81. An insertion plate 82 is pivotally mounted to the end of the insertion arm 78 and is actuated by hydraulic cylinder 83.

The insertion plate 82 is movable between a raised position and a lowered position. When the operator actuates the insertion arm 78, cylinder 81 causes the insertion arm 78 to move from a retracted position, as shown on the left side of FIG. 5, and an extended position, as shown on the fight side of FIG. 5. As the insertion arm 78 moves from the retracted position to the extended position, the insertion plate 82 is initially in its raised position (as shown in the left side of FIG. 5). After the forward end 91 of the insertion plate 82 clears the external ridge 92 of the tie plate 11, the insertion arm 78 contacts a first limit switch 95 which actuates the hydraulic cylinder 83 to move the insertion plate 82 to its lowered position (as shown in the right side of FIG. 5). As the insertion arm 78 continues to move toward its extended position, the forward end 91 of the insertion plate 82 pushes against the internal ridge 93 of the tie plate 11, urging the tie plate 11 between the rail 12 and the crosstie 13. When the tie plate 11 is in position below the rail 12, as shown on the fight side of FIG. 5, the insertion arm 78 contacts a second limit switch 96. The second limit switch actuates cylinder 83 to move the insertion plate 82 to its raised position, so that it will clear the tie plate 11 upon retraction, and cylinder 81 to move the insertion arm 78 to its retracted position. As a back-up to the second limit switch, a set screw 94 is mounted to the frame 41 of the magazine 33 in a position to stop the insertion arm 78, thereby preventing urging the tie plate 11 beyond the proper position below the rail 12.

While I have shown my invention in a single embodiment, it will be obvious to those skilled in the art that the invention is not so limited, but is susceptible of various changes and modifications without departing from the spirit thereof.

Having set forth the nature of the invention, what I claim is:

1. An apparatus for placing a tie plate intermediate a rail and a selected rail tie subjacent said rail comprising:

(a) a mobile frame;

(b) a magazine, connected to said mobile frame, said magazine having an upper end and a lower end, said lower end positioned just above said selected rail tie, said magazine comprising:

(i) a plurality of biased linkages for holding said tie plate above said selected rail tie; and (ii) means, proximal said lower end of said magazine for ejecting said tie plate from said magazine onto said selected rail tie;

(c) means, connected to said mobile flame proximal said magazine, for lifting said rail away from said selected rail tie such that said tie plate may be urged therebetween; and (d) means, adjacent said magazine, for urging said tie plate intermediate said rail and said selected rail tie.

2. An apparatus as defined in claim 1, wherein said magazine further comprises a guide plate extending from said upper end of said magazine to said lower end, adjacent said plurality of biased linkages, said linkages biased toward said guide plate such that said tie plate is urged against said guide plate when said tie plate is placed between one of said plurality of linkages and said guide plate.

3. An apparatus as defined in claim 2 wherein said linkages are arranged vertically along said guide plate.

4. An apparatus as defined in claim 3 wherein said guide plate has a lower end and a tie plate receiving side, and wherein said guide plate further comprises a plate stop extending outwardly from said tie plate receiving side of said guide plate, proximal said lower end of said guide plate.

5. An apparatus as defined in claim 4, wherein said magazine further comprises a retaining lever, pivotally mounted to said lower end of said magazine and movable between a retaining position and a release position, said retaining lever biased in said retaining position, such that said retaining lever urges a tie plate positioned on said plate stop toward said tie plate receiving side of said guide plate when said retaining lever is in said retaining position.

6. An apparatus as defined in claim 5, wherein said guide plate further has an external side opposite said tie plate receiving side, said lower end of said guide plate has a slot defined therethrough above said plate stop, and said ejecting means comprises:

(i) an ejection arm, having an impact end and an actuating end, said ejection arm positioned adjacent said external side of said lower end of said guide plate, said ejection arm movable between a rest position and an ejection position wherein said impact end of said ejection arm extends through said slot in said lower end of said guide plate, such that said tie plate positioned on said plate stop is urged away from said guide plate and onto said selected rail tie by said impact end when said ejection arm is in said ejection position; and (ii) means for actuating said ejection arm.

7. An apparatus as defined in claim 6, wherein said magazine further comprises a magazine frame and wherein said actuating means comprises a hydraulic cylinder mounted on said magazine frame and pivotally connected to said actuating end of said ejection arm.

8. An apparatus as defined in claim 6, wherein said means for urging said tie plate between said rail and said selected rail tie comprises:

(a) an insertion arm having a first end and a second end, said first end pivotally mounted to said magazine frame;

(b) an insertion plate mounted to said second end of said insertion arm; and (c) means for actuating said insertion arm.

9. An apparatus as defined in claim 3 wherein said linkages are biased with increasing force from said upper end of said magazine toward said lower end of said magazine.

10. An apparatus as defined in claim 9 wherein said linkages are spring-biased.

11. An apparatus as defined in claim 10 wherein said linkages are parallelogram linkages.

12. An apparatus as defined in claim 8 wherein said linkages are parallelogram linkages.

13. An apparatus as defined in claim 8 wherein said linkages are spring-biased.

14. An apparatus as defined in claim 8 wherein said linkages are biased with increasing force from said upper end of said magazine toward said lower end of said magazine.

15. An apparatus as defined in claim 9, further comprising a magnetic handle, disposed proximal said magazine, for use by an operator in placing said tie plate into said magazine.

16. An apparatus for placing a tie plate intermediate a rail and a selected rail tie subjacent said rail comprising:

(a) a mobile frame comprising a rotatable mounting head;

(b) a magazine, connected to said rotatable mounting head, said magazine having a lower end positioned just above said selected rail tie, said magazine comprising:

(i) means for holding said tie plate above said selected rail tie; and (ii) means, proximal said lower end of said magazine, for ejecting said tie plate from said magazine onto said selected rail tie;

(c) means, operatively connected to said rotatable mounting head, for aligning said magazine over said selected rail tie;

(d) means, connected to said mobile frame proximal said magazine, for lifting said rail away from said selected rail tie such that said tie plate may be urged therebetween;

(e) an insertion arm having a first end and a second end, said first end pivotally mounted adjacent said magazine;

(f) an insertion plate mounted to said second end of said insertion arm; and (g) means for actuating said insertion arm.

17. An apparatus as defined in claim 16 wherein said magazine further has an upper end, and wherein said means for holding said tie plate above said selected rail tie comprises:

(a) a guide plate, extending from said upper end of said magazine to said lower end;

(b) at least one biased linkage, adjacent to said guide plate, said linkage biased toward said guide plate such that said tie plate is urged against said guide plate when said tie plate is placed between said linkage and said guide plate.

18. An apparatus as defined in claim 17 wherein said guide plate has a lower end and a tie plate receiving side, and wherein said guide plate further comprises a plate stop extending outwardly from said tie plate receiving side of said guide plate, proximal said lower end of said guide plate.

19. An apparatus as defined in claim 18, wherein said guide plate further has an external side opposite said tie plate receiving side, said lower end of said guide plate has a slot defined therethrough above said plate stop, and wherein said ejecting means comprises:

(i) an ejection arm, having an impact end and an actuating end, said ejection arm positioned adjacent said external side of said lower end of said guide plate, said ejection arm movable between a rest position and an ejection position wherein said impact end of said ejection arm extends through said slot in said lower end of said guide plate, such that said tie plate positioned on said plate stop is urged away from said guide plate and onto said selected rail tie by said impact end when said ejection arm is in said ejection position; and (ii) means for actuating said ejection arm.

20. An apparatus as defined in claim 19 wherein said means for aligning comprises an indexing clamp for grasping said selected rail tie, said indexing clamp operatively connected to said mounting head such that said mounting head rotates in response to the position of said indexing clamp.

21. A tie plate insertion vehicle for placing a tie plate between a rail and a selected rail tie beneath said rail, comprising:

(a) a mobile frame;

(b) a magnetic pick-up wheel, mounted to said mobile frame, for retrieving loose tie plates;

(c) a collection slide, positioned adjacent said magnetic wheel, for collecting said tie plates from said magnetic wheel;

(d) a magazine, mounted to said mobile flame, said magazine having an upper end and a lower end, said lower end positioned above said selected rail tie, said magazine comprising a plurality of biased linkages for holding at least one of said tie plates above said selected rail tie, said magazine further comprising means proximal said lower end of said magazine for ejecting said one of said tie plates from said magazine onto said selected rail tie;

(e) means, connected to said mobile frame proximal said magazine, for lifting said rail away from said selected rail tie such that said tie plate may be urged therebetween; and (f) means, adjacent said magazine, for urging said tie plate intermediate said rail and said selected rail tie.

22. An apparatus as defined in claim 2, wherein said mobile frame comprises a mounting head, rotatably mounted on said mobile frame, and wherein said magazine is affixed to said mounting head.

23. An apparatus as defined in claim 22, further comprising means for aligning said mounting head with respect to said selected rail tie such that said magazine is in a proper position for ejecting said tie plate onto said selected rail tie.

24. An apparatus as defined in claim 23, wherein said means for aligning comprises an indexing clamp for grasping said selected rail tie, said indexing clamp operatively connected to said mounting head such that said mounting head rotates in response to the position of said indexing clamp.

25. An apparatus as defined in claim 9 wherein said linkages are parallelogram linkages.

26. An apparatus as defined in claim 9 wherein said linkages are spring-biased.

27. An apparatus as defined in claim 9 wherein said linkages are biased with increasing force from said upper end of said magazine toward said lower end of said magazine.

* * * * *